United States Patent [19]

Chagnot et al.

[11] Patent Number: 4,800,967

[45] Date of Patent: Jan. 31, 1989

[54] DRILLING MACHINE FOR DIGGING TRENCHES IN THE GROUND

[75] Inventors: Philippe Chagnot, Moret sur Loing; Jean-Pierre Schreiber, Mareil sur Mauldre, both of France

[73] Assignee: Soletanche, Nanterre, France

[21] Appl. No.: 82,032

[22] Filed: Aug. 5, 1987

[30] Foreign Application Priority Data

Aug. 7, 1986 [FR] France ..... 86 11460

[51] Int. Cl.[4] ..... E21B 4/04

[52] U.S. Cl. ..... 175/96; 37/94

[58] Field of Search ..... 175/95, 96; 299/59; 37/94; 30/355

[56] References Cited

U.S. PATENT DOCUMENTS

| | | | |
|---|---|---|---|
| 2,750,669 | 6/1956 | Hohmann | 30/355 |
| 2,895,218 | 7/1959 | Petzoldt | 30/355 |
| 3,681,863 | 8/1972 | Solntsev et al. | 37/97 |
| 3,894,587 | 7/1975 | Sourice | 175/91 |
| 4,694,915 | 9/1987 | Bauer et al. | 175/96 |

FOREIGN PATENT DOCUMENTS

| | | |
|---|---|---|
| 0207232 | 4/1986 | European Pat. Off. . |
| 1481221 | 4/1967 | France . |

*Primary Examiner*—David Wiecking
*Assistant Examiner*—James Lisehora
*Attorney, Agent, or Firm*—Schweitzer & Cornman

[57] ABSTRACT

A drilling machine for digging trenches in the ground of the type comprising at least one substantially vertical support plate (3) on which are mounted two drilling drums (2) one one each side of it for rotation about an axis (4) substantially perpendicular to the plate.

The downwardly facing edge surfaces of said plate have portions (13) inclined relative to the direction perpendicular to said plate.

3 Claims, 2 Drawing Sheets

DRILLING MACHINE FOR DIGGING TRENCHES IN THE GROUND

Figure 1:
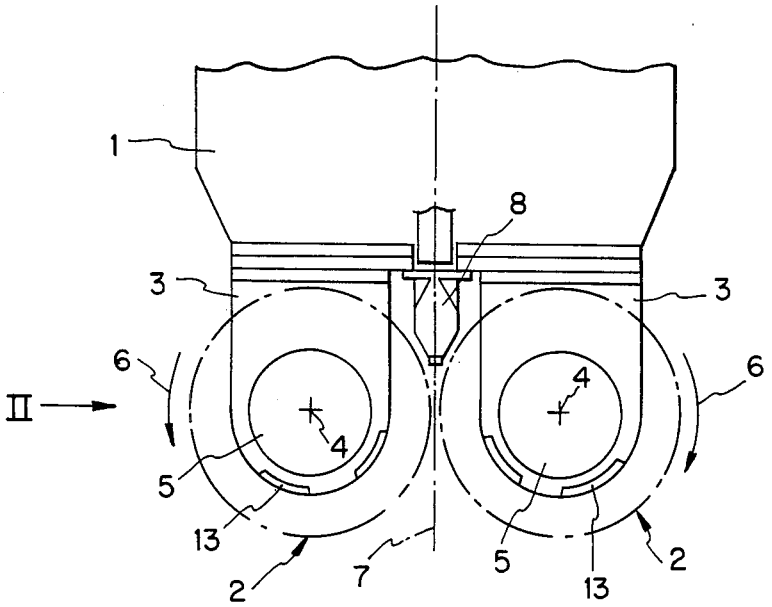

The present invention relates to a drilling machine for digging trenches in the ground, and more particularly to such a machine of the type comprising at least one substantially vertical support plate on which are mounted two drilling drums one on each side for rotation about an axis substantially perpendicular to the plate.

Such drilling machines are already known generally comprising two plates, supporting as a result four drums turning in pairs in opposite senses in such a manner as to sweep up the drilling rubble towards a suction tube situated on the axis of the machine.

In due course as such machines have been built of greater and greater capacity, an increase in the thickness of the support plate has been introduced in order to withstand the forces exerted by the ground on the drilling drums.

This thickness of the support plate creates difficulties when making a trench. In effect, the drill cutters mounted on the two drums adjacent the support plate must be sufficiently spaced from one another to allow the passage of this plate during rotation of the drums. This results in the formation of a bastion in the bottom of the trench, of a breadth generally at least equal to that of the plate.

During the descent of the drilling machine the lower edge of the support plate comes into abutment with this bastion, and may as a result impede the progress of the drilling.

Different solutions for this problem have already been proposed. Thus it has been suggested that the drilling cutters located adjacent the plate be mounted on the drums in a movable fashion, in such a manner as to bring the cutters of the two drums close to each other when they are in a position clear of the support plate. This solution has, however, turned out tricky to put into practice depending on the degree to which swivel axes of these cutters have to withstand very sizeable forces.

There have also been provided circular grooves in the support plate, centered on the axis of the drums, in a manner such that the drilling cutters fixedly mounted on the drums are separated by a distance less than the thickness of the plate. This solution has proved itself adequate. Nevertheless, with the thicknesses of plates presently used there still remains a bastion of sufficient size to withstand the weight of the drilling machine exerted via the lower edge surfaces of the support plate.

The present invention aims to furnish a different solution to the above discussed problem, optionally in combination with the already known means.

For this purpose, the invention has as its object a drilling machine for digging trenches in the ground, of the type comprising at least one substantially vertical support plate on which are mounted two drilling drums one on each side of it for rotation about an axis substantially perpendicular to the plate, characterised by the fact that the downwardly facing edge surfaces of said plate have portions inclined relative to the perpendicular to said plate, extending from one face of the plate to its other face.

Thus the weight of the drilling machine is transmitted to the bastion via these inclined portions, which thus exert on the bastion a lateral component of force which tends to break it. As a result, independently of means optionally used to reduce the thickness of the bastion, the present invention allows more easy disintegration of this bastion and assures improved penetration of the drilling machine.

The lower edge of said plate may for example be substantially semi circular, with said inclined portions being arranged following successive sectors of said lower edge.

In a preferred embodiment of the invention, a plurality of portions alternating in inclination to each side of the plate are provided.

Thus, the lateral forces exerted by the bastion on the drilling machine can have a substantially zero lateral component which avoids deviations by the machine and assures as a result the verticality of the trench.

Figure 3:
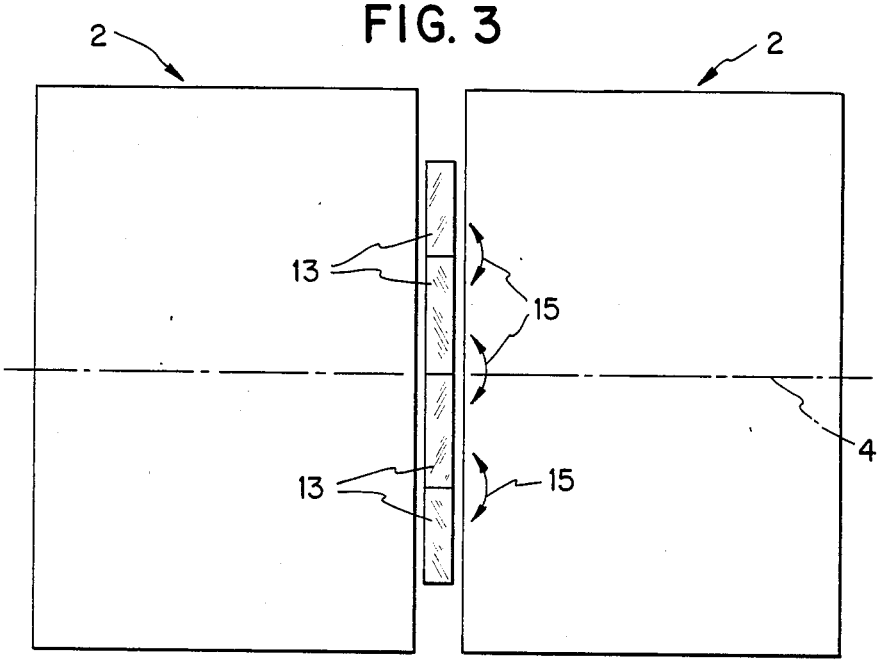
Figure 2:
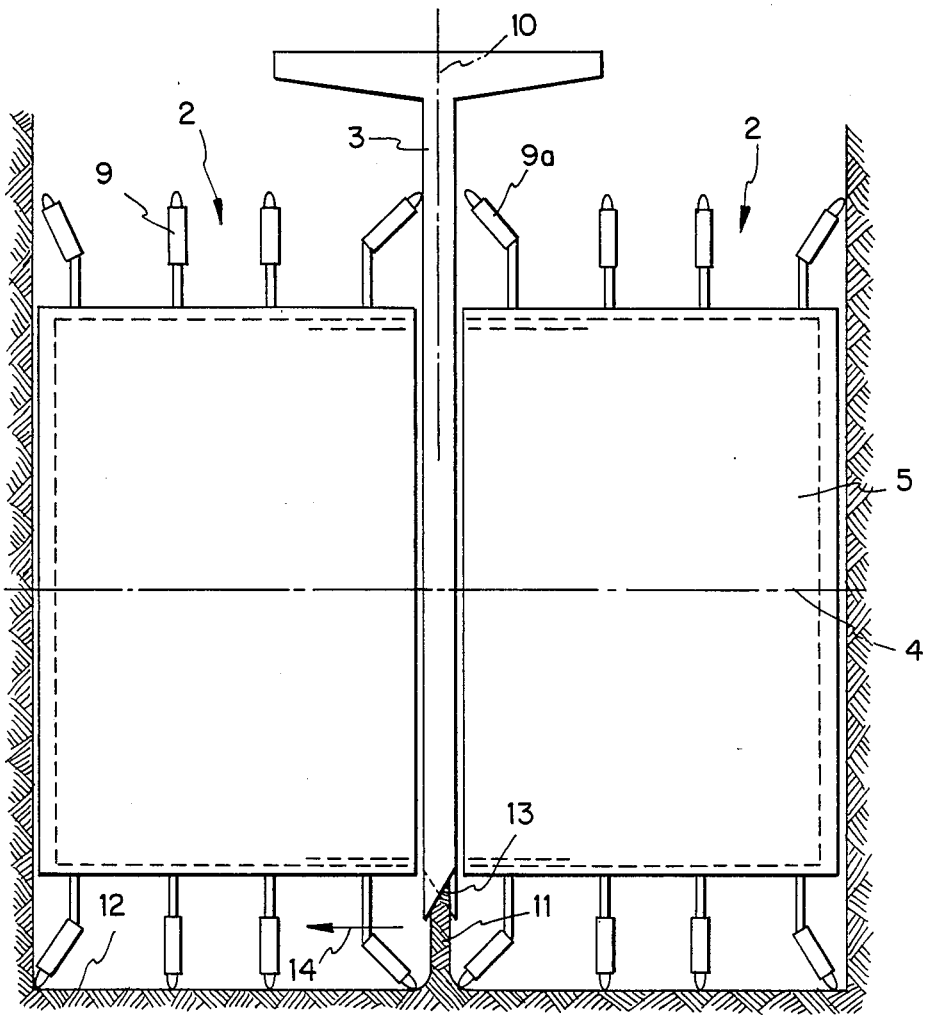

There is now described by way of non-limitative example a particular embodiment of the invention with reference to the attached schematic drawings in which:

FIG. 1 is a lateral view of the lower part of the drilling machine according to the invention, FIG. 2 is a view on a larger scale according to arrow II of FIG. 1, and FIG. 3 is a view from below of FIG. 2, on which the drilling picks have not been shown.

The drilling machine shown in FIG. 1 comprises in a known manner a frame 1 on the lower part of which are mounted two drilling drums 2 via vertical support plates 3. The axes 4 of rotation of the drums are perpendicular to the plates 3. In the present case, hydraulic motors 5 are mounted on the plates 3 and have their output shafts fast with the drums 2 in such a manner as to rotate them in opposite senses, in the senses of arrows 6. Thus, the soil disintegrated by the drums 2 is swept towards the lateral axis 7 of the drilling machine where it is sucked up by a suction tube 8.

As is shown in FIG. 2, the drilling drums 2 carry on their peripheries drilling picks 9 which assure the disintegration of the soil on rotation of the drums. The picks 9*a* nearest to the plate 3 are inclined towards the transverse axis 10 of this plate in such a manner as to approach each other as closely as possible.

On rotation of the drums 2 and descent of the drilling machine, there is nevertheless formed a bastion 11 at the bottom of the trench 12, a bastion whose thickness is at least equal to the thickness of plate 3, and on which the lower edge the plate 3 comes into abutment as the machine descends.

In order to facilitate disintegration of this bastion, the lower edge of each plate 3 which, in the present case, is semi-circular, comprises inclined surfaces 13. These surfaces are alternately inclined one way and then the other relative to axis 10 of plate 3 along successive sectors. Each inclined surface 13, inclined for example at 45°, starts on one face of the plate 3 and extends to its other face.

Thus, the weight of the drilling machine is brought to bear on the bastion 11, partly by transverse forces following arrow 14 of FIG. 2, and partly by torsional forces following arrows 15 of FIG. 3. These forces result in the rupture of bastion 11 in such a manner that this no longer obstructs the progress of drilling the trench.

It should be noted that the alternation of the orientation of surfaces 13 brings about a zero net transverse force on the drilling machine, as a result of which the latter is not diverted from the vertical as it proceeds.

It will be understood that various variants and modifications can be made to the description above without thereby going outside the frame or the spirit of the invention.

Thus in particular known means can be put into practice to reduce the thickness of the bastion before its disintegration by the means of the invention.

Similarly, the drilling drums, which have been described as driven by hydraulic motors located in their hubs may be driven by any other means, for example via chains connected to motors located in the frame.

We claim:

1. In a drilling machine for digging trenches in the ground, and of the type comprising at least one substantially vertical support plate on which are mounted two rotatable drilling drums, one on each side of said support plate, for rotation about an axis substantially perpendicular to the principal plane of the support plate, the improvement characterized by (a) said support plate having spaced apart opposite side surfaces and downwardly facing edges, (b) the downwardly facing edges of said vertical support plate being formed by sharply inclined surface portions extending from one side surface to the other and forming a sharply acute angle with one side surface and an obtuse angle with the other side surface, (c) said inclined surface portions being operative to displace laterally and rupture material left intact between said rotatable drilling drums during operation thereof.

2. A drilling machine according to claim 1, further characterized by (a) the downwardly facing edges of said support plate being formed by a plurality of successively adjacent edge portions, (b) each of said edge portions being inclined oppositely to an edge portion immediately adjacent thereto.

3. A drilling machine according to claim 1, further characterized by (a) the downwardly facing edges of said support plate being of convex arcuate configuration.

* * * * *